US006454181B1

(12) United States Patent
Griffith

(10) Patent No.: US 6,454,181 B1
(45) **Date of Patent: *Sep. 24, 2002**

(54) SUBWAY RAIL ANCHOR ASSEMBLY

(75) Inventor: Richard Griffith, Little Silver, NJ (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/877,769

(22) Filed: Jun. 8, 2001

(51) Int. Cl.[7] ..... E01B 9/30
(52) U.S. Cl. ..... 238/315; 238/310; 238/377
(58) Field of Search ..... 238/315, 310, 238/321, 343, 358, 377, 2, 5, 7, 25, 115

(56) References Cited

U.S. PATENT DOCUMENTS 4,090,665 A * 5/1978 Schlesener ..... 238/349
4,613,254 A * 9/1986 Liebig ..... 405/259.3
5,263,804 A * 11/1993 Ernst et al. ..... 405/259.5
5,568,711 A * 10/1996 Popp et al. ..... 405/259.5

* cited by examiner

*Primary Examiner*—S. Joseph Morano
*Assistant Examiner*—Frantz F. Jules
(74) *Attorney, Agent, or Firm*—Schwartz & Weinrieb

(57) ABSTRACT

An anchor assembly and a method of installing the same so as to secure an object to an underlying substructure comprises an insert member having an internally threaded bore, and an externally threaded headed bolt member for threaded engagement within said threaded bore of the insert member. A through-bore is formed within the object to be secured to the substructure, and the insert is inserted into the lower end portion of the through-bore, while the bolt member is inserted into the upper end portion of the through-bore whereby the bolt and insert members are threaded together. If the object is to be secured to a freshly poured batch of concrete material which will form the underlying substructure when the same hardens and sets, the lower end portion of the insert member is inserted into the freshly poured concrete which is then permitted to harden and set, whereas if the object is to be secured to an existing concrete foundation, a bore is formed within the concrete foundation, adhesive is deposited within the bore, and the insert member is inserted into the adhesive material which is then permitted to harden and set.

31 Claims, 4 Drawing Sheets

FIG. 3
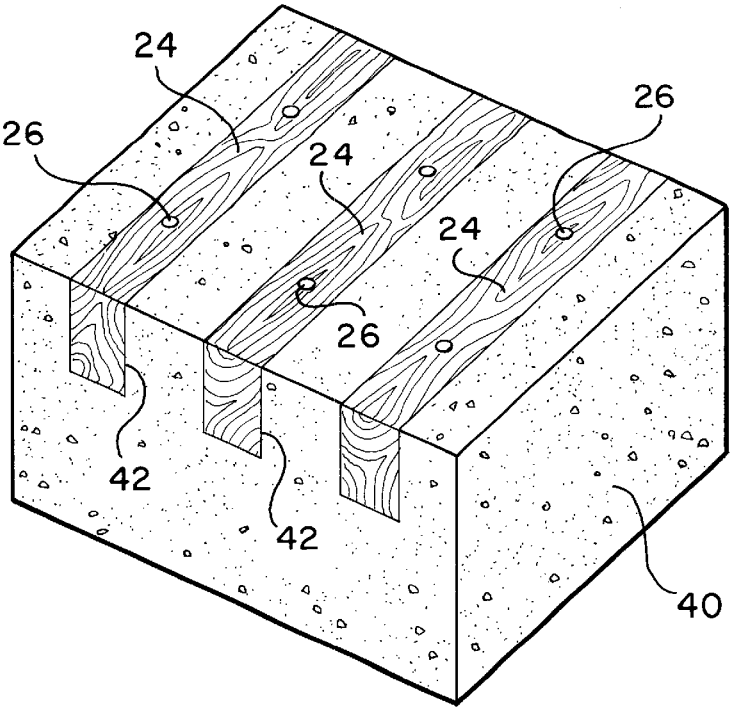
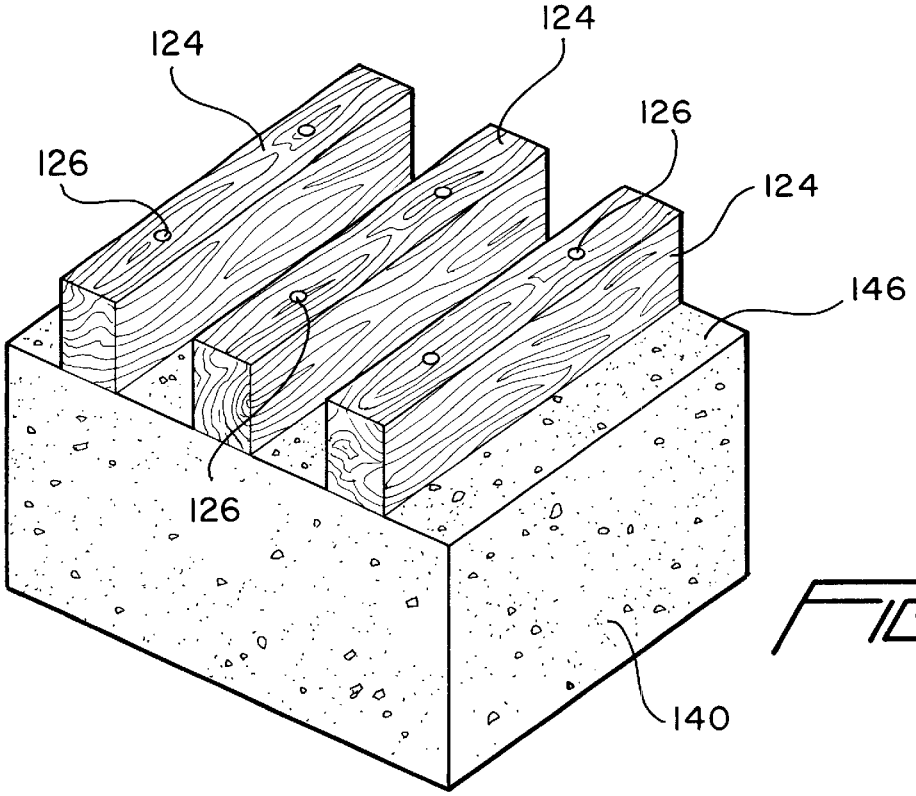
FIG. 5

SUBWAY RAIL ANCHOR ASSEMBLY

FIELD OF THE INVENTION

The present invention relates generally to anchor devices, implements, or assemblies which are adapted to be used in connection with the securing or fixation of objects or articles to concrete substrates or substructures, and more particularly to a new and improved anchor assembly, and a method of installing the same, which is especially useful in connection with the anchoring or fixation of wooden railroad or subway ties to an underlying concrete substructure or substrate which forms an integral part of a railroad or subway foundation.

BACKGROUND OF THE INVENTION

Wooden ties are conventionally secured to underlying railroad or subway concrete substrates or substructures in accordance with any one of several different well-known techniques, systems, or assemblies. In accordance with one well-known technique, system, or assembly, reinforcing bars are inserted within side portions of the wooden ties, and the wooden ties are then partially immersed or embedded within a freshly poured concrete foundation substrate or substructure. Accordingly, subsequent to the curing or setting of the concrete substrate or substructure, and as a resuit of the disposition of the reinforcing bars within the set or cured concrete, the wooden ties are now firmly secured within the concrete substrate or substructure. Unfortunately, however, over time, the wooden ties are subjected to various operational and environmental factors which tend to result in the structural deterioration of the wooden ties necessitating their replacement.

For example, the wooden ties are often subjected to large operational loads and structural vibrations. In addition, the ties are also periodically exposed to water and toxic chemicals which tend to cause the ties to rot or otherwise decay. As has therefore been noted, the wooden ties tend to structurally deteriorate in view of being exposed to such operational and environmental factors thereby necessitating their replacement in order to maintain the structural integrity of the rail system supported by means of such underlying wooden ties. However, as a result of the aforenoted embedded disposition of the wooden ties within the cured or set concrete substrate or substructure, particularly by means of the operatively associated reinforcing bars, when the structurally deteriorated wooden ties are in fact to be replaced, it is necessary to break up or partially destroy the concrete substrate or substructure in order to in effect gain access to the wooden ties and therefore be able to remove or extract the damaged or deteriorated wooden ties from the concrete substrate or substructure. Not only are such procedures tedious and time-consuming, but in addition, such procedures are effectively wasteful of resources in that the original concrete substrate or substructure must firstly be partially destroyed, and then, secondly, the concrete substrate or substructure must, in effect, be subsequently repaired by embedding or immersing the new replacement wooden ties within a freshly poured section of the concrete substrate or substructure foundation.

In accordance with another well-known technique, system, or assembly for conventionally securing wooden ties to underlying railroad or subway concrete substrates or substructures, a plurality of expansion anchors are operatively associated with the wooden ties and inserted within fastener bore holes suitably formed at predetermined locations within the concrete substrate or substructure. However, it has been experienced that, again, over the course of time, and as a result of such expansion anchor fasteners being subjected to the aforenoted large operational loads and structural vibrations inherently attendant the operation of the railroad or subway systems, the expansion anchor fasteners tend to work themselves loose with respect to their associated bore holes defined within the concrete substrate or substructure thereby adversely affecting the structural integrity of the wooden ties and the overlying rail system.

A need therefore exists in the art for a new and improved anchor assembly, and a method of installing the same, which is especially useful in connection with the anchoring or fixation of wooden railroad or subway ties to an underlying concrete substructure or substrate which forms an integral part of a railroad or subway foundation.

OBJECTS OF THE INVENTION

Accordingly, it is an object of the present invention to provide a new and improved anchor assembly, and a method of installing the same, which is especially useful in connection with the anchoring or fixation of wooden railroad or subway ties to an underlying concrete substructure or substrate which forms an integral part of a railroad or subway foundation.

Another object of the present invention is to provide a new and improved anchor assembly, and a method of installing the same, which is especially useful in connection with the anchoring or fixation of wooden railroad or subway ties to an underlying concrete substructure or substrate which forms an integral part of a railroad or subway foundation, and which effectively overcomes the various operational disadvantages and drawbacks characteristic of the PRIOR ART systems.

An additional object of the present invention is to provide a new and improved anchor assembly, and a method of installing the same, which is especially useful in connection with the anchoring or fixation of wooden railroad or subway ties to an underlying concrete substructure or substrate which forms an integral part of a railroad or subway foundation, and which readily, easily, and simply enables the replacement of the wooden ties, as necessary, without requiring the partial destruction of the underlying concrete substrate or substructure in order to remove or extract the damaged or deteriorated wooden tie members.

A further object of the present invention is to provide a new and improved anchor assembly, and a method of installing the same, which is especially useful in connection with the anchoring or fixation of wooden railroad or subway ties to an underlying concrete substructure or substrate which forms an integral part of a railroad or subway foundation, and which can withstand the substantially large operational loads and structural vibrational forces attendant operation of the railroad or subway system such that the wooden ties remain tightly secured to the underlying concrete substrate or substructure.

A last object of the present invention is to provide a new and improved anchor assembly, and a method of installing the same, which is especially useful in connection with the anchoring or fixation of wooden railroad or subway ties to an underlying concrete substructure or substrate which forms an integral part of a railroad or subway foundation, and which can be used in connection with a pre-existing concrete substrate or substructure foundation, or alternatively, in connection with a freshly poured concrete substrate or substructure foundation.

SUMMARY OF THE INVENTION

The foregoing and other objectives are achieved in accordance with the teachings and principles of the present invention through the provision of a new and improved anchor assembly, and a method of installing the same, which is especially useful in connection with the anchoring or fixation of wooden railroad or subway ties to an underlying concrete substructure or substrate which forms an integral part of a railroad or subway foundation, wherein the anchor assembly primarily comprises an externally threaded rod member having an internally threaded bore, a cylindrical or tubular sleeve or spacer member, and an externally threaded headed bolt member which is adapted to be axially inserted through the sleeve or spacer member such that the non-headed threaded end of the bolt member is threadedly engaged within the internally threaded bore of the externally threaded rod member. In order to respectively mount an anchor assembly, constructed in accordance with the principles and teachings of the present invention, upon any one of the wooden tie members at any location along the longitudinal extent of any one of the wooden tie members, a through-bore is initially made within each wooden tie member at each one of the longitudinally located anchor assembly mounting sites. The externally threaded rod member is then inserted into the wooden tie through-bore from the underside of the wooden tie while the sleeve or spacer member is inserted into the wooden tie through-bore from the top side of the wooden tie. The externally threaded bolt member is then coaxially aligned with, and inserted within, the upper end of the sleeve or spacer member, and the other end of the bolt member is threadedly engaged with the internally threaded bore of the externally threaded rod member so as to be hand-tightened to a substantially fully engaged state.

Accordingly, in order to fixedly secure any one of the wooden tie members to the underlying concrete substrate or substructure foundation by means of the anchor assemblies constructed in accordance with the principles and teachings of the present invention, and when the wooden ties are to be fixedly secured to a pre-existing concrete substrate or substructure foundation, a bore hole is formed within the concrete substrate or substructure foundation, and a suitable adhesive is deposited within the bore hole formed within the concrete substrate or substructure so as to partially fill the same. The anchor assembly and the wooden tie member are then disposed above the bore hole formed within the concrete substrate or sub-structure, and the lower end of the externally threaded rod member is inserted into the bore hole so as to be embedded, immersed, or submerged within the adhesive material disposed within the concrete substrate or substructure bore hole while the wooden tie member is in effect seated upon the upper external surface of the concrete foundation. The externally threaded headed bolt member and the sleeve or spacer member are then moved axially downwardly or through the through-bore defined within the wooden tie member so as to not only ensure that the head portion of the bolt member is substantially flush with the upper surface of the wooden tie member so as not to project any more than necessary above the upper side of the wooden tie member, but in addition, to effectively force the externally threaded rod member to be entirely embedded, submerged, or immersed within the adhesive material disposed within the concrete substrate or substructure bore hole. Upon complete curing or setting of the adhesive material, the threaded bolt member is then tightened to its final suitably torqued state with respect to the threaded rod member thereby fixing the wooden tie member in place.

Alternatively, when the wooden ties are to be fixedly secured within a freshly poured concrete substrate or substructure, the externally threaded rod member, the sleeve or spacer member, and the threaded headed bolt member are all assembled with respect to the wooden tie member as noted hereinabove in connection with the installation of the anchor assembly upon a pre-existing concrete substrate or substructure, however, the step of drilling the bore holes within the concrete is obviously omitted as there is no concrete slab or foundation within which such bore holes could be bored. To the contrary, the wooden tie members, having the anchor assemblies mounted therein at predetermined longitudinal positions thereof, are suspended above a mold site, within which the concrete material is to be poured, such that when the concrete material is in fact poured into the mold, the lower end of the externally threaded rod member will be disposed within the freshly poured concrete material so as to be completely embedded or immersed within the concrete material while the wooden tie member is likewise partially embedded within the freshly poured concrete slab or foundation.

Accordingly, the externally threaded headed bolt member and the spacer or sleeve member are moved axially downwardly or through the through-bore defined within the wooden tie member so as to, again, not only ensure that the head portion of the bolt member is substantially flush with the upper surface of the wooden tie member so as not to project any more than necessary above the upper surface of the wooden tie member, but in addition, such movement effectively forces the externally threaded rod member to be disposed at an elevational level whereby the same is entirely embedded, submerged, or immersed within the concrete material at a predetermined depth or level well below the upper surface of the concrete material when the concrete material is poured into the concrete material mold. Upon complete curing or setting of the concrete material, the threaded bolt member is then tightened to its final suitably torqued state with respect to the threaded rod member thereby fixing the wooden tie member in place.

The fact that the lower portions of the wooden tie members are partially embedded within the cured or set concrete does not present any substantial problems in connection with the subsequent removal or replacement of the wooden tie members because any bond which may have been developed between the wooden tie members and the set or cured concrete material will effectively be broken due to the aforenoted large operational loads and structural vibrations attendant operations of the railroad or subway transportation systems. Thus, this is contrary to the PRIOR ART system wherein the reinforcing bar members were in fact fixedly embedded and fully immersed within the cured or set concrete foundation rendering the ready or simple removal of the wooden tie members impossible. Accordingly, the wooden ties anchored to the concrete foundation in accordance with the principles and teachings of the present invention can be easily, readily, and simply removed and replaced without requiring in effect partial destruction of the underlying concrete foundation.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein:

FIG. 3 is a schematic perspective view showing the disposition of a plurality of wooden tie members as embedded within a newly or freshly formed concrete substrate or substructure foundation;

FIG. 5 is a schematic perspective view showing the disposition of a plurality of wooden tie members as secured to an existing concrete substrate or substructure foundation.

DETAILED DESCRIPTION OF THE PREFERRED EMBODIMENT

Figure 1:
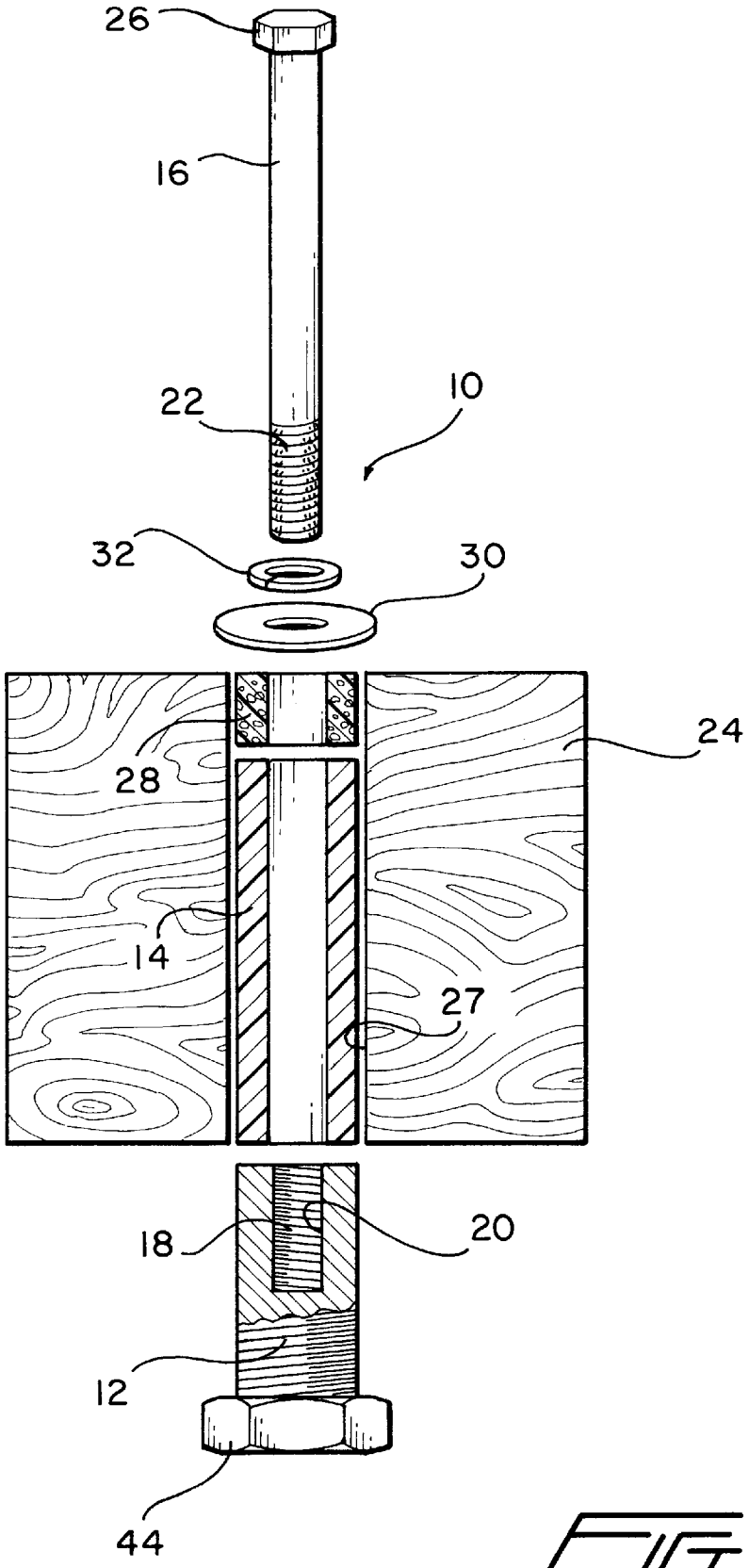
FIG. 1 is an exploded, side elevational view, partially in cross-section, of a first embodiment of a new and improved anchor assembly which is constructed in accordance with the principles and teachings of the present invention for use in connection with the anchoring or fixation of wooden railroad or subway ties to an underlying, freshly poured concrete substrate or substructure foundation.

Referring now to the drawings, and more particularly to FIG. 1 thereof, a first embodiment of a new and improved anchor assembly, which is constructed in accordance with the principles and teachings of the present invention for use in connection with the anchoring or fixation of wooden railroad or subway ties to an underlying, freshly poured concrete substrate or substructure foundation, is disclosed and is generally indicated by the reference character 10. More particularly, it is seen that the first embodiment of the new and improved anchor assembly 10 comprises an externally threaded rod member 12, a tubular spacer or sleeve member 14, and an externally threaded headed bolt member 16. The externally threaded rod member 12 may be fabricated from a suitable metal, such as, for example, grade 304 stainless steel, and is seen to have an axial length of, for example, 3.50 inches and an outside diameter dimension of 1.50 inches. The upper end portion of the externally threaded rod member 12, as respectively viewed in FIG. 1 and as considered in effect when the externally threaded rod member 12 is disposed in its proper vertical orientation once the externally threaded rod member 12 is mounted or disposed in its deployed mode within an underlying concrete substrate or substructure, has a blind bore 18 defined therein. The blind bore 18 has an axial length of 2.00 inches, an inside diameter of 1.00 inch, and is internally threaded with a peripheral thread 20 having eight threads per inch.

Figure 2:
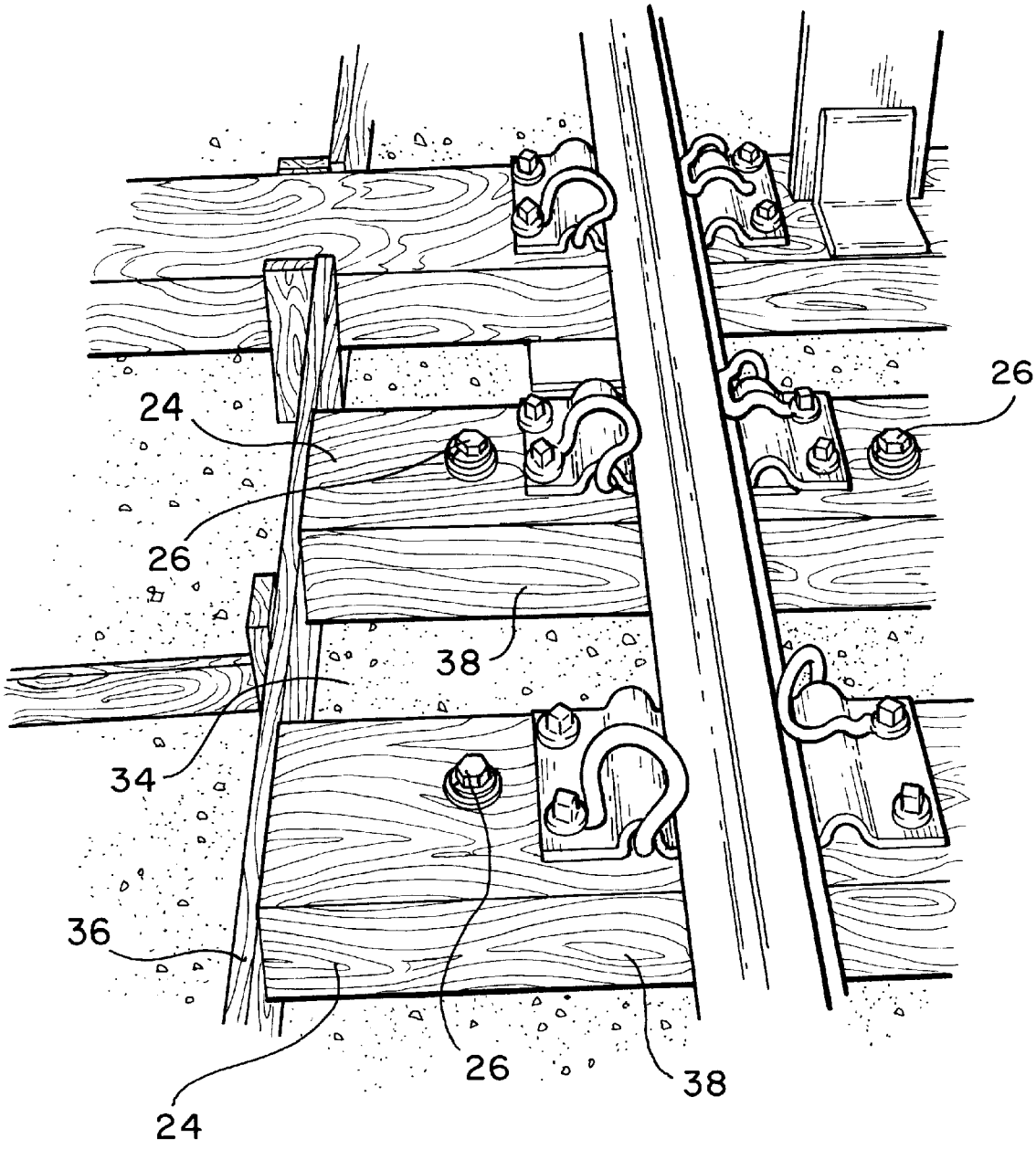
FIG. 2 is a perspective view of a plurality of wooden ties respectively having a plurality of anchor assemblies, as disclosed in detail in FIG. 1, fixedly mounted therein and disposed in connection with a concrete forming-mold in preparation for the formation of a freshly-poured concrete substrate or substructure foundation within which the plurality of wooden ties and anchor assemblies are to be embedded.

As will also be more apparent hereinafter, the internally threaded bore 18 of the externally threaded rod member 12 is adapted to be threadedly engaged with the lower end portion of the externally threaded shank portion 22 of the headed bolt member 16, as respectively viewed in FIG. 1 and as considered in effect when the externally threaded headed bolt member 16 is disposed in its proper vertical orientation once the externally threaded headed bolt member 16 is mounted or disposed in its deployed mode with respect to the wooden ties 24 as seen in FIG. 2. In a manner similar to that characteristic of the externally threaded rod member 12, the externally threaded headed bolt member 16 may likewise be fabricated from a suitable metal, such as, for example, grade 304 stainless steel, and is provided with a hexagonal head portion 26. The externally threaded headed bolt member 16 has an outside diameter dimension of 1.00 inch so as to match the inside diameter dimension of the threaded bore 18 formed within externally threaded rod member 12, and the external thread defined upon the lower end portion of the externally threaded shank portion 22 of the headed bolt member 16 has eight threads per inch. It is further noted that when the headed bolt member 16 is to be used in conjunction with a wood tie 24, as disclosed within FIG. 2, which has a depth or thickness dimension of approximately 6.00 inches, the headed bolt member 16 will have an axial length of approximately 7.00 inches, whereas when the headed bolt member 16 is to be used in conjunction with a wood tie 24 which has a depth or thickness dimension of approximately 5.00 inches, the headed bolt member 16 will have an axial length of approximately 6.00 inches.

In addition to an operative function which will be described hereinafter, the tubular spacer or sleeve member 14 is provided so as to house or accommodate the threaded shank portion 22 of the headed bolt member 16, as well as to axially and radially guide and confine the threaded shank portion 22 of the headed bolt member 16 whereby the threaded mating of the same with the internally threaded bore 18 defined within the threaded rod member 12 is facilitated. More particularly, the tubular spacer or sleeve member 14 may be fabricated from a suitable plastic material, such as, for example, NYLON®, and it is to be noted that the tubular spacer or sleeve member 14 has an outside diameter dimension of, for example, 1.75 inches and an inside diameter dimension of, for example, 1.0625 inches. In this manner, the outside diameter dimension of the tubular spacer or sleeve member 14 is just slightly larger than that of the externally threaded rod member 12, while the inside diameter dimension of the tubular spacer or sleeve member 14 is justly slightly larger than that of the externally threaded shank portion 22 of the headed bolt member 16.

Accordingly, when the externally threaded rod member 12, the tubular spacer or sleeve member 14, and the externally threaded headed bolt member 16 are assembled together so as to comprise the anchor assembly 10, the lower end portion of the tubular spacer or sleeve member 14, as respectively viewed in FIG. 1 and as considered in effect when the tubular spacer or sleeve member 14 is disposed in its proper vertical orientation once the anchor assembly 10 is mounted or disposed in its deployed mode with respect to the wooden ties 24 and the underlying concrete substrate or substructure foundation, will be seated upon the upper end bore portion of the externally threaded rod member 12. In addition, it is to be noted that each tubular spacer or sleeve member 14 is adapted to be disposed internally within a through-bore 27 formed within each one of the wooden tie members 24, as will be discussed hereinafter, and accordingly, when a wooden tie 24 having a depth or thickness dimension of 6.00 inches is being used, the tubular spacer or sleeve member 14 will have an axial length dimension of approximately 5.50 inches, whereas when a wooden tie 24 having a depth or thickness dimension of 5.00 inches is being used, the tubular spacer or sleeve member 14 will have an axial length dimension of approximately 4.50 inches.

In addition to the aforenoted anchor assembly components comprising the externally threaded rod member 12, the tubular spacer or sleeve member 14, and the externally threaded headed bolt member 16, it is further seen from FIG. 1 that a crush ring member 28, a flat washer 30, and a lock washer 32 are adapted to be mounted upon the upper end portion of the tubular spacer or sleeve member 14 so as to be interposed between such upper end portion of the tubular spacer or sleeve member 14 and the hexagonal head portion 26 of the externally threaded headed bolt member 16 when the headed bolt member 16 is threadedly engaged within the internally threaded bore 18 of the externally threaded rod member 12. The flat washer 30 and the lock washer 32 may be fabricated from a suitable metal, such as, for example, grade 304 stainless steel, and it is also noted that the flat washer 30 has an outside diameter dimension of 2.50 inches. The flat washer 30 serves to support the hexagonal head portion 26 of the externally threaded bolt member 16 upon the upper end of the crush ring member 28 and upon the upper surface portion of the wooden tie 24 when the anchor assembly 10 is fully and properly mounted within the wooden tie 24, and the lock washer 32 serves, in effect, to lock the externally threaded headed bolt member 16 at its fully tightened and torqued position with respect to the threaded rod member 12 once the externally threaded headed bolt member 16 is fully threadedly engaged and torqued to the desired tension level with respect to the threaded rod member 12 in connection with the final installation of the wooden ties 24 upon the underlying concrete substrate or substructure foundation as will be discussed more fully hereinafter. It is similarly noted that the crush ring member 28 serves to, in effect, absorb axially impressed forces attendant the tightening and torquing operation of the headed bolt member 16 with respect to the threaded rod member 12 such that the proper degree, to which the headed bolt member 16 is in fact tightened and torqued with respect to the threaded rod member 12, is in fact achieved without causing or impressing any structural damage to or upon the plastic tubular spacer or sleeve member 14. In order to achieve these operational functions and results, it is further noted that the crush ring member 28 may be fabricated from a suitable material, such as, for example, STYROFOAM® or the like, the axial length dimension of the crush ring member 28 may be within therange of 0.500–0.750 inches, the outside diameter dimension of the crush ring member 28 is 1.75 inches, and the inside diameter dimension of the crush ring member 28 is 1.00 inch. It is therefore appreciated that the total or combined axial length dimension of the tubular spacer or sleeve member 14 and the crush ring member 28 is always at least equal to, and preferably just slightly greater than, the depth or thickness dimension of the wooden tie member 24 as will be explained more fully hereinafter.

With additional reference now being made to FIG. 2, when it is desired to install the plurality of wooden tie members 24 upon and within a freshly poured concrete substrate or substructure foundation, the wooden ties 24 are disposed at a predetermined height above a floor portion 34, which may comprise excavated earth or an old concrete foundation, and a suitable conventional concrete material mold is initially formed. It is particularly noted that wooden mold members 36, which in effect form one side of the concrete substrate or substructure foundation, are disposed in contact with one end portion of each one of the wooden ties 24 such that when the wooden mold members 36 are removed after the poured concrete material has set or hardened, those ends of the wooden ties 24 which were in effect covered by means of the wooden mold members 36 will not be embeded or immersed within the concrete substrate or substructure but, to the contrary, will be exposed. This exposure of such ends of the wooden ties 24 enables the wooden ties 24 to be subsequently removed from the concrete substrate or substructure foundation in a relatively easy manner. More particularly, it can be appreciated that when the concrete material is poured into the mold regions, the concrete material will attain a level whereby the vertical sides 38 of each wooden tie member 24 will be substantially entirely submerged within the concrete material, although the upper surface portions of the wooden tie members 24 will remain entirely exposed.

Accordingly, it can be further appreciated that once the concrete material sets or hardens and forms the underlying concrete substrate or substructure foundation, which is schematically shown at 40 in FIG. 3, the wooden tie members 24 will in effect be disposed within channel portions 42 which are formed within the concrete substrate or substructure 40 as best seen in FIG. 3, wherein the channel portions 42 are open along the upper surface thereof as well upon the one end thereof due to the aforenoted presence of the wooden mold members 36 in surface contact with the noted ends of the wooden ties 24. It has been experienced that although the wooden tie members 24 will have in effect been initially bonded to the concrete substrate or substructure foundation 40 as a result of the setting or hardening of the same, the wooden tie members 24 do not remain bonded to the concrete substrate or substructure foundation 40 due to the operational loading and structural vibrations attendant the operation of the railroad or subway over an extended period of time, and therefore, the wooden tie members 24 can be readily removed from the aforenoted open top and end of each channel 42 when replacement of the wooden tie members 24 is required.

In connection with the use of each one of a pluralrality of anchor assemblies 10 within each one of the wooden tie members 24, and in preparation for the partial embedment or immersion of the wooden tie members 24 within the underlying concrete substrate or substructure foundation 40, it is seen, as disclosed within FIG. 1, that each anchor assembly 10 further comprises, for example, an internally threaded hexagonal nut 44 which is adapted to be threadedly mounted upon the bottom end portion of externally threaded rod member 12. In addition to being threadedly mounted upon the externally threaded rod member 12, it is also preferable to weld the nut member 44 to the lower end portion of the externally threaded rod member 12 once the nut member 44 is threadedly engaged upon the rod member 12. The threaded nut 44 has an inside diameter dimension of 1.50 inches, has an axial length dimension of 0.800 inches, and serves to further anchor the externally threaded rod member 12 within the newly or freshly poured concrete substrate or substructure foundation 40 once the concrete material forming the foundation 40 sets or hardens. It is of course to be noted further that in lieu of the provision of a separate nut member 44 upon the lower or bottom end portion of the externally threaded rod member 12, the threaded rod member 12 may have, in effect, other similarly operable alternative structures. For example, a head or flanged portion may be integrally formed upon the lower end portion of the threaded rod member 12 such that the threaded rod member 12 and its integral head or flanged portion comprise a one-piece structure.

In connection then with the mounting of the plurality of anchor assemblies 10 within the plurality of wooden tie members 24, and the subsequent mounting of the anchor assemblies 10 and the wooden tie members 24 within a freshly formed underlying concrete substrate or substructure foundation 40, the bore holes 27 having an inside diameter dimension of, for example, 1.75 inches, are initially formed within each one of the wooden tie members 24 at predetermined locations along the longitudinal extent thereof at which anchor assemblies 10 are to be disposed. The anchor assemblies 10 are initially disassembled by threadedly removing the externally threaded headed bolt members 16 from their respective internally threaded bores 18 formed within their associated externally threaded rod members 12, and subsequently, the externally threaded rod member 12 of each anchor assembly 10 is inserted through the bottom end of each bore hole 27 formed within each wooden tie member 24, while the tubular spacer or sleeve member 14 and the externally threaded headed bolt member 16, with the crush ring 28, flat washer 30, and lock washer 32 components interposed therebetween, are inserted through the top end of each bore hole 27 formed within the wooden tie members 24. Each externally threaded headed bolt member 16 is then threadedly engaged within the internally threaded bore 18 of each operatively associated externally threaded rod member 12 until each bolt member 16 and rod member 12 are sufficiently tightened, with respect to each other, by hand so as to be fully threadedly engaged.

The plurality of wooden tie members 24, now having their anchor assemblies 10 mounted therein, are then disposed by suitable means, not shown, at predetermined elevations above the concrete mold floor 34, and the concrete material is then poured or dispensed into the mold. At this time, if need be, the anchor assemblies 10 disposed within the wooden ties 24 are moved axially downwardly so as to render the flat washer 30 and bolt head member 26 components substantially flush with the upper surface of each wooden tie member 24, although the flat washer 30 and the bolt head member 26 might actually be disposed just slightly above the upper surface of the wooden tie 24 due to the upward protrusion of the upper end of the crush ring 28 above the upper surface of the wooden tie 24. In any case, this axially downward movement of each anchor assembly 10 to its lowest possible extent with respect to the wooden tie 24 ensures the fact that each threaded rod member 12, and its associated nut member 44, will be disposed at an elevational level at which such members 12,44 will be sufficiently submerged or immersed within the freshly poured concrete material forming foundation 40. It is to be noted that the provision of the rod or insert member 12 as an externally threaded rod or insert member 12 serves to enhance the retention of the same within the hardened or set concrete when the concrete substructure in fact hardens or sets.

It is to be noted at this juncture that as a result of the provision of the tubular spacer or sleeve member 14, as well as crush ring member 28, and in particular the disposition of such components atop the externally threaded rod member 12, such components serve the important function of, in effect, sealing the internal bore 27 of the wooden tie 24 such that the freshly poured concrete material cannot penetrate or be disposed around the externally threaded shank portion 22 of the bolt member 16. Accordingly, upon hardening or setting of the concrete material, wherein each threaded rod member 12 and each nut member 44 are now immovably fixed within the concrete substrate or substructure foundation 40 as a result of, in effect, being bonded therein, each threaded bolt member 16 may nevertheless be further tightened, with respect to its operatively associated rod member 12, to a predetermined torque level, thereby fixing the wooden ties 24 within the concrete substrate or substructure foundation 40. The disposition of the crush ring member 28, particularly in view of its slight upward protrusion above the upper surface of the wooden tie 24, enables the achievement of such highly torqued tightening or tensioning level impressed upon bolt member 16. It is also to be appreciated that if the flat washer 30 and bolt head 26 encounter the upper surface of the wooden tie 24 before a sufficiently desired torque level is achieved, further tightening or torquing of the bolt 16 will still be enabled as a result of the bolt head 26 effectively forcing the flat washer 30 to become slightly embedded within the upper surface of the wooden tie 24, as also permitted by the crush ring member 28, without damaging the tubular sleeve or spacer member 14.

In accordance with the unique and novel teachings and principles of the present invention, it is to be further appreciated that when the wooden ties 24 need to be replaced, the replacement procedure not only can be readily, easily, simply, and quickly accomplished, but in addition, the need for destroying the previously formed concrete foundation 40, even partially, has been obviated. More particularly, when a particular wooden tie 24 is to be replaced, all of the anchor assemblies 10 operatively associated with such wooden tie member 24 are initially disassembled by threadedly disengaging the threaded bolt members 16 from their operatively associated threaded rod members 12 which of course, are fixedly embedded within the concrete foundation 40. The tubular spacer or sleeve member 14, as well as the crush ring 28, flat washer 30, and lock washer 32 are also removed from the anchor assembly location. Accordingly, the wooden tie member 24 is now no longer anchored to the underlying concrete substrate or substructure foundation 40 and may be removed from its previously anchored position with respect to the underlying foundation 40 by either simply sliding the wooden tie member 24 out from the aforenoted channel 42 formed within the underlying foundation 40 in a substantially intact state, or if need be, removed in pieces from the aforenoted channel. It is to again be emphasized, however, that destruction of the underlying concrete foundation 40 need not be performed in order to in fact remove or extract the wooden tie member 24.

Subsequently, a new wooden tie member 24 can be slidably inserted into the vacant channel 42 within which the original wooden tie member 24 was disposed, and each anchor assembly 10 can then be reassembled. More particularly, in view of the fact that the channels 42 formed within the underlying concrete foundation 40, and within which the wooden tie members 24 are disposed, are in effect only open at one end thereof as well as along the upper surface thereof, it is to be noted that when each new wooden tie member 24 is inserted into its respective channel 42, the new wooden tie member 24 will be able to be disposed at substantially precisely the same position at which the old, now removed, tie member 24 was disposed within its channel 42. Accordingly, the bores 27 formed within the new wooden tie members 24, and the tubular spacer or sleeve members 14 and the threaded bolt members 16 axially disposed within such bores 27 formed within the new wooden tie members 24, are able to be readily coaxially aligned with the internally threaded bores 18 of the externally threaded rod members 12 so as to in fact facilitate the threaded re-engagement or reassembly of the threaded bolt members 16 with their respective threaded rod members 12. Therefore, upon threaded engagement of the threaded bolt members 16 with their respective threaded rod members 12, and the torquing of the same to their predetermined torque or tension levels, the newly inserted wooden tie members 24 are now fixedly secured to the underlying concrete substrate or substructure foundation 40.

Figure 4:
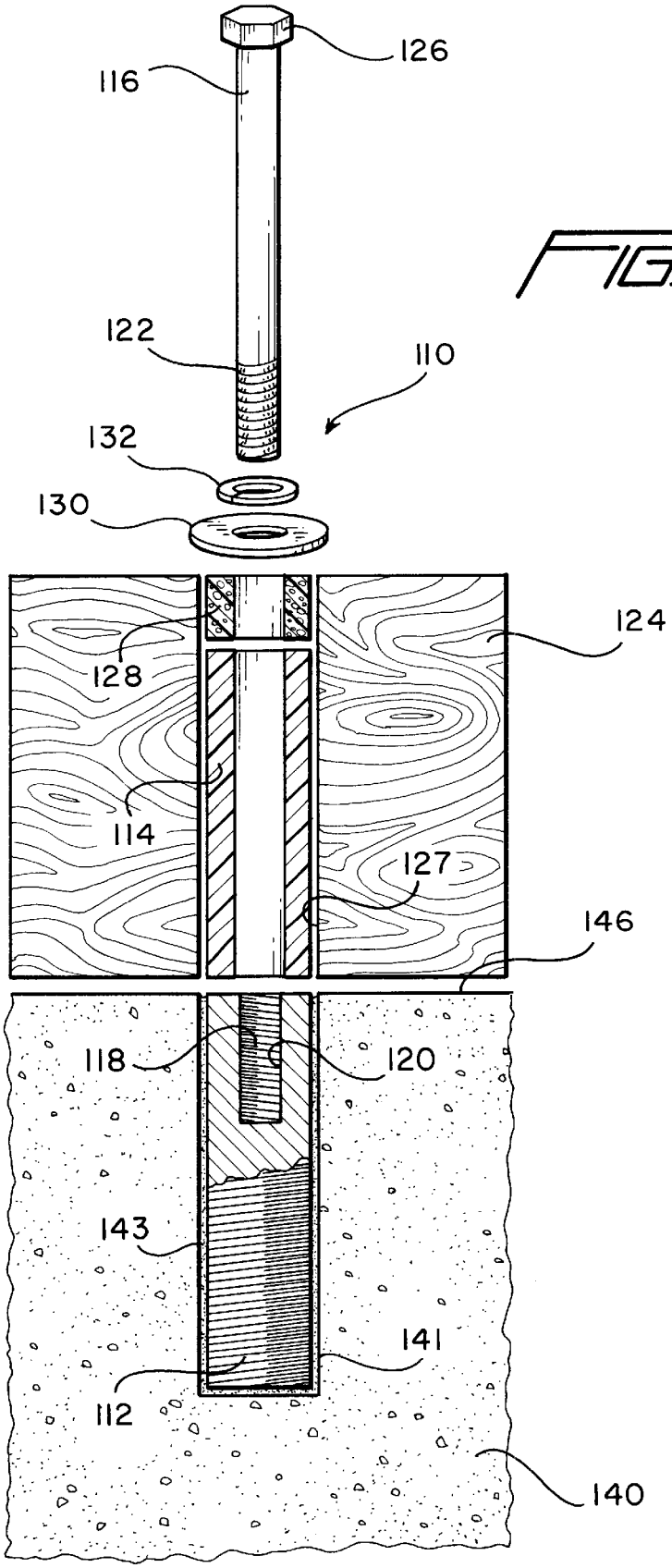
FIG. 4 is an exploded, side elevational view, partially in cross-section, of a second embodiment of a new and improved anchor assembly which is constructed in accordance with the principles and teachings of the present invention for use in connection with the anchoring or fixation of wooden railroad or subway ties to an underlying, pre-existing concrete substrate or substructure foundation.

Referring now to FIG. 4, a second embodiment of a new and improved anchor assembly, which is likewise constructed in accordance with the principles and teachings of the present invention for use in connection with the anchoring or fixation of wooden railroad or subway ties to an existing underlying, concrete substrate or substructure foundation, is disclosed and is generally indicated by the reference character 110. It is to be noted that, as can readily be appreciated from a comparison between the first and second embodiments of the anchor assemblies 10,110 as disclosed within FIGS. 1 and 4, the structures of the anchor assemblies 10,110 are in fact quite similar, and therefore, in accordance with brevity, a full detailed discussion of the second embodiment of the anchor assembly 110 as disclosed within FIG. 4 will be omitted, the following discussion being directed substantially only toward those structural features of the anchor assembly 110 which differ from those structural features of the anchor assembly 10. It is also noted that the various structural components of the anchor assembly 110 will be referenced by numerals which correspond to those designating similar structural components of the anchor assembly 10, however, the reference characters or numerals for anchor assembly 110 will be within the 100 series. Continuing further, then, as has been noted, the new and improved anchor assembly 110 is adapted for use in connection with the anchoring or fixation of wooden railroad or subway ties to a pre-existing underlying, concrete substrate or substructure foundation 140 as shown in FIG. 5, and accordingly, and obviously, contrary to the partial embedment of the wooden tie members 24 within the freshly formed concrete foundation 40 as shown in FIG. 3, the wooden tie members 124 are adapted to be secured atop, or affixed to, for example, an upper surface portion 146 of an existing concrete substrate or substructure foundation 140. Accordingly, and in particular, the only major structural difference between the anchor assembly 110 of the present invention as shown in FIG. 4, as compared to the anchor assembly 10 of the present invention as shown in FIG. 1, resides in the fact that the nut member 44 has been eliminated, and in addition, the axial length of the externally threaded rod member 112 is substantially longer than the axial length of the externally threaded rod member 12. In particular, the axial length dimension of the externally threaded rod member 112 is 5.00 inches. Still further, there is also a major difference in the method of installing or affixing the wooden tie members 124 with respect to the underlying concrete foundation 140 as compared to the method employed in connection with securing or affixing the wooden tie members 24 to the underlying concrete foundation 40.

More particularly, in view of the fact that the wooden tie members 124 are to be secured to affixed to an existing underlying concrete foundation 140, whereby the threaded rod members 112 cannot be affixed within the underlying concrete foundation 140 during formation of the underlying concrete foundation 140, the threaded rod members 112 must obviously be secured or affixed to the underlying concrete foundation by other means. Accordingly, in accordance with the principles and teachings of the present invention, blind bores 141 are initially formed at predetermined locations within the underlying concrete foundation 140, each blind bore 141 having a depth of approximately 5.00 inches and an inside diameter dimension of 1.750 inches. The anchor assemblies 110 are also assembled within the bores 127 formed within the wooden ties 124 in a manner similar to that previously described in connection with the mounting of the anchor assemblies 10 within the wooden tie members 24. When the anchor assemblies 110 have therefore been mounted within their respective wooden tie members 124, a suitable adhesive material 143 is deposited within each one of the bores 141 formed within the underlying existing concrete foundation 140 such that the bores 141 formed within the underlying concrete foundation 140 are partially filled to approximately one-half of their depth. A suitable adhesive material 143 that may be used, may comprise, for example, either ACRYLIC 7 or CERAMIC 6 adhesive, which are both well-known in the industry.

Subsequently, the wooden ties 124, having their anchor assemblies 110 mounted therein, are disposed atop the existing concrete foundation 140 whereby the lower end portions of the externally threaded rod members 112 can be inserted into the bores 141 formed within the existing concrete foundation 140 so as to be embedded or immersed within the adhesive material 143 disposed within the bores 141 formed within the concrete foundation 140. If need be, as was the case with the anchor assemblies 10 with respect to the wooden tie members 24, the anchor assemblies 110 can also be moved axially downwardly so as to substantially dispose the flat washer 130 and head portion 126 of the bolt member 116 in a substantially flush position with respect to the upper surface portion of each wood tie member 124 and to ensure the fact that the threaded rod member 112 is disposed at an elevational level which is fully and completely embedded or immersed within the adhesive material 143 disposed within the concrete foundation bores 141. As was the case with the first embodiment anchor assembly 10, the provision of the externally threaded rod or insert member 112 serves to enhance the bonding of such rod or insert member 112 within the adhesive material 143. Upon complete curing or setting of the adhesive material 143, the threaded bolt members 116 can be fully torqued to predetermined tension levels with respect to the threaded rod members 112 such that the anchor assemblies 110, and the wooden tie members 124, are now fixedly secured to the underlying concrete foundation 140.

Accordingly, and still further, when individual wooden tie members 124 need to be replaced, they may in fact be readily, easily, simply, and quickly replaced as a result of the disengagement of each bolt member 116 from its operatively associated threaded rod member 112 and the removal of the bolt member 116, along with its associated tubular spacer or sleeve member 114, crush ring 128, flat washer 130, and lock washer 132, in a manner similar to that previously described in connection with the replacement of the wooden tie members 24. In a similar manner, the new or replacement wooden tie members 124 may be secured or affixed to the underlying concrete foundation 140 in a manner similar to that previously described in connection with the fixation of the replacement wooden tie members 24 upon the underlying concrete foundation 40 as a result of the re-engagement or reassembly of the threaded bolt members 116 with the threaded rod members 112 affixed within the underlying concrete foundation 140.

Thus, it may be seen that in accordance with the principles and teachings of the present invention, there has been provided an anchor assembly, and a method of attaching the same either to existing underlying concrete foundations, or newly formed concrete foundations, as a result of which wooden tie members, used in conjunction with the mounting of rail members within railroad or subway systems, can be readily, easily, simply, and quickly replaced as necessary without any need to even partially destroy the underlying concrete foundation.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A method of securing an object to an existing underlying concrete substructure, comprising the steps of:

forming a through-bore within said object to be secured to said existing underlying concrete substructure wherein said through-bore has a lower end portion and an upper end portion;

disposing an insert member, having an internally threaded bore defined therein, within the vicinity of said lower end portion of said through-bore formed within said object to be secured to said existing underlying concrete substructure;

inserting a tubular sleeve member into said through-bore formed within said object to be secured to said existing underlying concrete substructure such that said tubular sleeve member is seated upon an upper end portion of said insert member;

inserting a headed bolt member, having an externally threaded shank portion, into said upper end portion of said through-bore formed within said object to be secured to said existing underlying concrete substructure such that said threaded shank portion of said bolt member will be guidably disposed within said tubular sleeve member disposed within said through-bore formed within said object to be secured to said existing underlying concrete substructure;

threadedly engaging a lower end portion of said externally threaded shank portion of said bolt member within said internally threaded bore defined within said insert member;

forming a bore within said existing underlying concrete substructure;

partially filling said bore formed within said existing underlying concrete substructure with an adhesive material;

inserting said insert member within said adhesive material; and permitting said adhesive material to harden and set so as to fixedly secure said insert member within said adhesive material and said existing underlying concrete substructure so as to in turn fixedly mount said object upon said existing underlying concrete substructure.

2. The method as set forth in claim 1, further comprising the step of:

threadedly engaging said externally threaded bolt member within said internally threaded bore of said insert member to a predetermined torqued tension level after said adhesive material has hardened and set so as to fixedly secure said object to said existing underlying substructure.

3. The method as set forth in claim 2, further comprising the step of:

interposing a crush ring member between an upper end portion of said tubular sleeve member and a head portion of said headed bolt member so as to effectively absorb axial compression forces attendant said torqued tensioning of said bolt member with respect to said insert member.

4. The method as set forth in claim 1, wherein:

said object to be secured to said underlying substructure comprises a wooden tie member for supporting railroad tracks.

5. The method as set forth in claim 1, further comprising the step of:

providing said insert member as an externally threaded rod member wherein the external threads enhance bonding within said adhesive material when said adhesive material sets and hardens.

6. An anchor assembly for fixedly but removably securing an object to an underlying substructure, comprising:

an insert member adapted to be fixedly and fully immersed within the underlying substructure, said insert member having an irregular external surface portion for facilitating the fixed retention of said insert member within a hardenable material comprising a portion of the underlying substructure when the hardenable material sets, and having an internally threaded blind bore defined therein and extending axially inwardly from an open end defined within an upper end of said insert member;

a bolt member having an externally threaded shank portion at a first end thereof for threaded engagement within said internally threaded blind bore defined within said insert member, and having means at a second end thereof for exerting a compressive force upon the object when said first externally threaded shank portion is threadedly engaged within said internally threaded blind bore defined within said insert member; and a tubular sleeve member adapted to be disposed within and extend through the object to be secured to the underlying substructure so as to substantially house that portion of said shank portion of said bolt member which is interposed between said insert member and said compressive force exerting means of said bolt member, and for radially confining said shank portion of said bolt member so as to facilitate said threaded engagement of said externally threaded shank portion of said bolt member with said internally threaded blind bore of said insert member, an upper end portion of said tubular sleeve member being disposed adjacent to said compressive force exerting means of said bolt member, and a lower end portion of said tubular sleeve member being disposed in engaged contact with upper end surface means of said insert member for defining a seal between said lower end portion of said tubular sleeve member and said upper end surface means of said insert member so as to seal said open upper end of said internally threaded blind bore of said insert member and thereby prevent the ingress of the hardenable material, comprising a portion of the underlying substructure, into said internally threaded blind bore of said insert member prior to the setting of the hardenable material.

7. The anchor assembly as set forth in claim 6, wherein:

a crush ring member is interposed between an upper end portion of said tubular sleeve member and said compressive force exerting means of said bolt member for axially absorbing axial forces attendant tensioned torquing of said bolt member with respect to said insert member when said bolt member is fully threadedly engaged with respect to said insert member.

8. The anchor assembly as set forth in claim 6, wherein:

said insert member comprises an externally threaded rod member wherein the external threads enhance bonding within the underlying substructure when the underlying substructure comprises freshly poured concrete which is subsequently permitted to set.

9. The anchor assembly as set forth in claim 8, wherein:

a nut member is fixedly secured upon a lower end portion of said externally threaded insert member for additional bonded embedment within the underlying substructure when the underlying substructure comprises freshly poured concrete which is subsequently permitted to set.

10. The anchor assembly as set forth in claim 6, wherein:

said insert member comprises an externally threaded rod member wherein the external threads enhance bonding within an adhesive material disposed within a bore formed within the underlying substructure when the adhesive material is subsequently permitted to set.

11. In combination, an object to be fixedly secured to an underlying substructure, and an anchor assembly for fixedly but removably securing the object to the underlying substructure, comprising:

said object to be secured to the underlying substructure has a through-bore defined therein;

an insert member adapted to be fixedly and fully immersed within the underlying substructure, said insert member having an irregular external surface portion for facilitating the fixed retention of said insert member within a hardenable material comprising a portion of the underlying substructure when the hardenable material sets, and having an internally threaded blind bore defined therein and extending axially inwardly from an open end defined within an upper end of said insert member;

a bolt member having an externally threaded shank portion at a first end thereof for threaded engagement within said internally threaded blind bore defined within said insert member, and having means at a second end thereof for exerting a compressive force upon said object when said first externally threaded shank portion is threadedly engaged within said internally threaded blind bore defined within said insert member; and a tubular sleeve member adapted to be disposed within and extend through said through-bore of said object to be secured to the underlying substructure so as to substantially house that portion of said shank portion of said bolt member which is interposed between said insert member and said compressive force exerting means of said bolt member, and for radially confining said shank portion of said bolt member so as to facilitate said threaded engagement of said externally threaded shank portion of said bolt member with said internally threaded blind bore of said insert member, an upper end portion of said tubular sleeve member being disposed adjacent to said compressive force exerting means of said bolt member, and a lower end portion of said tubular sleeve member being disposed in engaged contact with upper end surface means of said insert member for defining a seal between said lower end portion of said tubular sleeve member and said upper end surface means of said insert member so as to seal said open upper end of said internally threaded blind bore of said insert member and thereby prevent the ingress of the hardenable material, comprising a portion of the underlying substructure, into said internally threaded blind bore of said insert member prior to the setting of the hardenable material.

12. The combination as set forth in claim 11, wherein:

said object to be secured to the underlying substructure comprises a railroad wooden tie.

13. The combination as set forth in claim 11, wherein:

a crush ring member is interposed between an upper end portion of said tubular sleeve member and said compressive force exerting means of said bolt member for axially absorbing axial forces attendant tensioned torquing of said bolt member with respect to said insert member when said bolt member is fully threadedly engaged with respect to said insert member.

14. The combination as set forth in claim 11, wherein:

said insert member comprises an externally threaded rod member wherein the external threads enhance bonding within the underlying substructure when the underlying substructure comprises freshly poured concrete which is subsequently permitted to set.

15. The combination as set forth in claim 14, wherein:

a nut member is fixedly secured upon a lower end portion of said insert member for bonded embedment within said underlying substructure when said underlying substructure comprises freshly poured concrete which is subsequently permitted to set.

16. The combination as set forth in claim 11, wherein:

said insert member comprises an externally threaded rod member wherein the external threads enhance bonding within an adhesive material disposed within a bore formed within the underlying substructure when the adhesive material is subsequently permitted to set.

17. In combination, an object to be fixedly secured to an underlying substructure, and an anchor assembly for fixedly securing the object to the underlying substructure, comprising:

said underlying substructure;

said object to be secured to said underlying substructure has a through-bore defined therein;

an insert member adapted to be fixedly and fully immersed within said underlying substructure, said insert member having an irregular external surface portion for facilitating the fixed retention of said insert member within a hardenable material comprising a portion of said underlying substructure when the hardenable material sets, and having an internally threaded blind bore defined therein and extending axially inwardly from an open end defined within an upper end of said insert member;

a bolt member having an externally threaded shank portion for threaded engagement within said internally threaded blind bore defined within said insert member, and having means at a second end thereof for exerting a compressive force upon said object when said first externally threaded shank portion is threadedly engaged within said internally threaded blind bore defined within said insert member; and a tubular sleeve member adapted to be disposed within and extend through said through-bore of said object to be secured to said underlying substructure so as to substantially house that portion of said shank portion of said bolt member which is interposed between said insert member and said compressive force exerting means of said bolt member, and for radially confining said shank portion of said bolt member so as to facilitate said threaded engagement of said externally threaded shank portion of said bolt member with said internally threaded blind bore of said insert member, an upper end portion of said tubular sleeve member being disposed adjacent to said compressive force exerting means of said bolt member, and a lower end portion of said tubular sleeve member being disposed in engaged contact with upper end surface means of said insert member for defining a seal between said lower end portion of said tubular sleeve member and said upper end surface means of said insert member so as to seal said open upper end of said internally threaded blind bore of said insert member and thereby present the ingress of the hardenable material, comprising a portion of said underlying substructure, into said internally threaded blind bore of said insert member prior to the setting of the hardenable material.

18. The combination as set forth in claim 17, wherein:

said object to be secured to the underlying substructure comprises a railroad wooden tie.

19. The combination as set forth in claim 17, wherein: said underlying substructure comprises freshly poured concrete; and said insert member is fixedly bonded within said freshly poured concrete underlying substructure as a result of the hardened setting of said freshly poured concrete.

20. The combination as set forth in claim 19, wherein:

said insert member comprises an externally threaded rod member wherein the external threads enhance bonding within said freshly poured concrete underlying substructure when said freshly poured concrete sets.

21. The combination as set forth in claim 20, wherein:

a nut member is fixedly secured upon a lower end portion of said insert member for bonded embedment within said underlying concrete substructure when said freshly poured concrete sets.

22. The combination as set forth in claim 17, wherein:

a crush ring member is interposed between an upper end portion of said tubular sleeve member for axially absorbing axial forces attendant tensioned torquing of said bolt member with respect to said insert member when said bolt member is fully threadedly engaged with respect to said insert member.

23. The combination as set forth in claim 17, wherein:

said underlying substructure comprises an existing concrete foundation having a bore formed therein; and an adhesive material is disposed within said bore of said insert member within said existing concrete foundation underlying substructure.

24. The combination as set forth in claim 23, wherein:

said insert member comprises a externally threaded rod member wherein the external threads enhance bonding within said adhesive material disposed within said bore of said existing concrete foundation underlying substructure when said adhesive material sets.

25. A method of removably securing an object to an underlying substructure, comprising the steps of:

forming a through-bore within said object to be secured to said underlying substructure wherein said through-bore has a lower end portion and an upper end portion;

disposing an insert member, having an internally threaded blind bore defined therein and extending axially inwardly from an open end defined within an upper end portion of said insert member, within the vicinity of said lower end portion of said through-bore formed within said object to be secured to said underlying substructure;

inserting a tubular sleeve member into said through-bore formed within said object to be secured to said underlying substructure such that a lower end portion of said tubular sleeve member is seated upon an upper end portion of said insert member;

inserting a bolt member, having an externally threaded shank portion, into said upper end portion of said through-bore formed within said object to be secured to said underlying substructure such that said threaded shank portion of said bolt member will be guidably disposed within said tubular sleeve member disposed within said through-bore formed within said object to be secured to said underlying substructure;

threadedly engaging a lower end portion of said externally threaded shank portion of said bolt member within said internally threaded blind bore defined within said insert member such that said lower end portion of said tubular sleeve member seated upon said upper end portion of said insert member is tightly engaged with said upper end portion of said insert member so as to seal said open end of said internally threaded blind bore of said insert member and thereby prevent the ingress of freshly poured concrete material into said internally threaded blind bore of said insert member when said insert member is fully immersed within a freshly poured batch of concrete material;

fully immersing at least said insert member within a freshly poured batch of concrete material which will form said underlying substructure when said freshly poured concrete material hardens and sets; and permitting said freshly poured batch of concrete material to harden and set so as to form said underlying substructure within which said insert member is fixedly secured so as to in turn fixedly yet removably mount said object to said underlying substructure.

26. The method as set forth in claim 25, further comprising the step of:

threadedly engaging said externally threaded bolt member within said internally threaded bore of said insert member to a predetermined torqued tension level after said freshly poured concrete material has hardened and set so as to fixedly secure said object to said underlying substructure.

27. The method as set forth in claim 26, further comprising he step of:

interposing a crush ring member between an upper end portion of said tubular sleeve member and a head portion of said headed bolt member so as to effectively absorb axial compression forces attendant said torqued tensioning of said bolt member with respect to said insert member.

28. The method as set forth in claim 25, wherein:

said object to be secured to said underlying substructure comprises a wooden tie member for supporting railroad tracks.

29. The method as set forth in claim 28, further comprising the step of:

partially embedding said wooden tie member within said freshly poured concrete material such that when said freshly poured concrete material hardens and sets, said wooden tie member will be disposed within a channel formed within said hardened and set concrete underlying substructure.

30. The method as set forth in claim 25, further comprising the step of:

providing said insert member as an externally threaded rod member wherein the external threads enhance bonding within said freshly poured concrete underlying substructure when said freshly poured concrete sets and hardens.

31. The method as set forth in claim 30, further comprising the step of:

threadedly engaging a nut member upon a lower end portion of said externally threaded rod member so as to further enhance the bonding of said insert member within said freshly poured concrete underlying substructure when said freshly poured concrete sets and hardens.

* * * * *